US008672573B2

(12) United States Patent
Francoeur

(10) Patent No.: US 8,672,573 B2
(45) Date of Patent: Mar. 18, 2014

(54) WATER-SAVER CLEANING DEVICE

(76) Inventor: Yvon Francoeur, Laval (CA)

( * ) Notice: Subject to any disclaimer, the term of this patent is extended or adjusted under 35 U.S.C. 154(b) by 970 days.

(21) Appl. No.: 12/744,177

(22) PCT Filed: Sep. 22, 2008

(86) PCT No.: PCT/CA2008/001669

§ 371 (c)(1),
(2), (4) Date: May 21, 2010

(87) PCT Pub. No.: WO2009/065210

PCT Pub. Date: May 28, 2009

(65) Prior Publication Data

US 2010/0282275 A1 Nov. 11, 2010

Related U.S. Application Data

(60) Provisional application No. 60/989,829, filed on Nov. 22, 2007.

(51) Int. Cl.
*A46B 11/06* (2006.01)

(52) U.S. Cl.
USPC ..... 401/289; 401/43; 401/45; 401/46; 222/132

(58) Field of Classification Search
USPC ..... 401/289, 43–47; 222/132, 144.5, 145.5, 222/145.7
See application file for complete search history.

(56) References Cited

U.S. PATENT DOCUMENTS

| | | | | |
|---|---|---|---|---|
| 1,277,805 | A * | 9/1918 | Wingers | 401/289 |
| 2,748,411 | A * | 6/1956 | O'Brien | 401/15 |
| 4,033,480 | A * | 7/1977 | Di Maio | 222/129 |
| 4,764,047 | A | 8/1988 | Johnston et al. | |
| 5,695,293 | A * | 12/1997 | Chase | 401/44 |
| 6,164,496 | A | 12/2000 | Gregory | |
| 7,004,663 | B1 * | 2/2006 | Cupidon-Ebanks | 401/279 |
| 8,136,698 | B1 * | 3/2012 | Beaulieu | 222/94 |
| 2006/0242774 | A1 * | 11/2006 | Schmid | 15/29 |

* cited by examiner

*Primary Examiner* — David Walczak
(74) *Attorney, Agent, or Firm* — Pearl Cohen Zedek Latzer Baratz LLP

(57) ABSTRACT

A cleaning device to be connected with a water hose, the cleaning device comprising a water inlet at a first end for receiving the water hose, an outlet assembly having a brush located at a first end thereof, a cleaning mixture reservoir in fluid communication with the outlet assembly, and a flow selection assembly operatively coupled to the water inlet, the outlet assembly and the cleaning mixture reservoir, the flow selection assembly comprising a switch assembly for switching between a water and cleaning mixture dispensing mode wherein the water inlet is in fluid communication with the cleaning mixture reservoir and the outlet assembly and the water is dispensed at a first given flow rate and a cleaning mode wherein the water inlet is in fluid communication with the outlet assembly and the water is dispensed at a second given flow rate greater than the first given flow rate.

15 Claims, 17 Drawing Sheets

WATER-SAVER CLEANING DEVICE

CROSS-REFERENCE TO RELATED APPLICATIONS

This application is a National Phase Application of PCT International Application No. PCT/CA2008/001669, International Filing Date Sep. 22, 2008, and claims priority of U.S. Provisional Patent Application No. 60/989,829 filed Nov. 22, 2007, both of which are incorporated by reference herein.

FIELD OF THE INVENTION

The invention relates to a cleaning device. More specifically, this invention pertains to a water-saver cleaning device to be connected to a water hose.

BACKGROUND OF THE INVENTION

Portable cleaning devices are used for instance for cleaning vehicles. To that purpose, it is very desirable to use an existing water source in order to be able to provide water in a continuous manner.

Unfortunately, those portable cleaning devices often suffer from various drawbacks and their use is often cumbersome.

In particular, they need water to operate and may accordingly require the connecting to/operating of the water source which may be complicated and be the source of water waste.

The cleaning of a vehicle usually requires the steps or operations of providing water on the vehicle, providing cleaning mixture on the vehicle, brushing the vehicle with the provided cleaning mixture on it and rinsing the vehicle with water.

An operator may have to leave the portable cleaning device on the ground while cleaning the vehicle using cleaning mixture. The skilled addressee will appreciate that this leads to great amounts of water being wasted, which is not desirable.

Furthermore, usual water sources provide a flow rate of water of about 12 L/min and a typical washing of a vehicle consumes about 144 L of water for a small vehicle such as a car and about 180 L of water for a larger vehicle such as a pick-up truck. This amount of water consumed is superior to the amount of water required for a thorough cleaning of a vehicle.

There is therefore a need for a cleaning device that will overcome at least one of the above-identified drawbacks.

Features of the invention will be apparent from review of the disclosure, drawings and description of the invention below.

BRIEF SUMMARY OF THE INVENTION

In order to address the above-identified and other drawbacks, and in accordance with the present invention, there is disclosed a cleaning device to be connected with a water hose.

It will be appreciated by the skilled addressee that the term "water" is hereby used to designate any liquid one may see fit for the use of the present invention. For instance, instead of a water hose, the cleaning device herein described may be connected to a hose providing a liquid mixture comprising a disinfectant such as an alcohol-based disinfectant, an aldehyde-based disinfectant, an oxidizing agent-based disinfectant or the like.

The cleaning device comprises a water inlet at a first end for receiving the water hose. The cleaning device further comprises an outlet assembly having a brush located at a first end thereof and a cleaning mixture reservoir in fluid communication with the outlet assembly. The cleaning device further comprises a flow selection assembly operatively coupled to the water inlet, the outlet assembly and the cleaning mixture reservoir. The flow selection assembly comprises a switch assembly for switching between a water and cleaning mixture dispensing mode wherein the water inlet is in fluid communication with the cleaning mixture reservoir and the outlet assembly and the water is dispensed at a first given flow rate and a cleaning mode wherein the water inlet is in fluid communication with the outlet assembly and the water is dispensed at a second given flow rate greater than the first given flow rate.

There is further provided a method for cleaning an object using a cleaning device. The method first comprises the step of providing a cleaning device connected to a water hose, the cleaning device comprising a water inlet at a first end for receiving the water hose, an outlet assembly having a brush located at a first end thereof, a cleaning mixture reservoir in fluid communication with the outlet assembly and a flow selection assembly operatively coupled to the water inlet, the outlet assembly and the cleaning mixture reservoir, the flow selection assembly comprising a switch assembly for switching between a water and cleaning mixture dispensing mode wherein the water inlet is in fluid communication with the cleaning mixture reservoir and the outlet assembly and the water is dispensed at a first given flow rate and a cleaning mode wherein the water inlet is in fluid communication with the outlet assembly and the water is dispensed at a second given flow rate greater than the first given flow rate.

The method for cleaning an object using a cleaning device further comprises the steps of providing cleaning mixture inside the cleaning mixture reservoir, of providing water to the water inlet of the cleaning device, of positioning the brush near an object to be cleaned, the outlet assembly facing towards the object and of selecting the water and cleaning mixture dispensing position using the flow selection assembly for dispensing water and cleaning mixture at a first given flow rate onto the object until the object is partially covered with a predetermined amount of water and cleaning mixture. The method for cleaning an object using a cleaning device further comprises the steps of brushing the object using the brush until the predetermined amount of water and cleaning mixture is spread out on the object in a predetermined fashion and of selecting the cleaning position using the flow selection assembly for dispensing water at a second given flow rate higher than the first given flow rate onto the object until a predetermined amount of cleaning mixture previously dispensed onto the object is rinsed off the object.

There is further provided a method for manufacturing the cleaning device herein described, consisting in assembling the water inlet, the outlet assembly, the cleaning mixture reservoir and the flow selection assembly using an assembling method.

There is further provided a method for cleaning an object using the cleaning device herein described wherein the water hose is connected to a water source and cleaning mixture is provided in the cleaning mixture reservoir.

The object of this invention is to reduce waste of water during cleaning of an object. In some circumstances, one embodiment of the present invention may providing a saving of about 81% of the total amount of water used in the cleaning of an object.

These and other objects, advantages and features of the present invention will become more apparent to those skilled in the art upon reading the details of the invention more fully set forth below.

BRIEF DESCRIPTION OF THE DRAWINGS

In order that the invention may be readily understood, embodiments of the invention are illustrated by way of example in the accompanying drawings.

Further details of the invention and its advantages will be apparent from the detailed description included below.

DETAILED DESCRIPTION

In the following description of the embodiments, references to the accompanying drawings are by way of illustration of an example by which the invention may be practiced. It will be understood that other embodiments may be made without departing from the scope of the invention disclosed.

Figure 1:
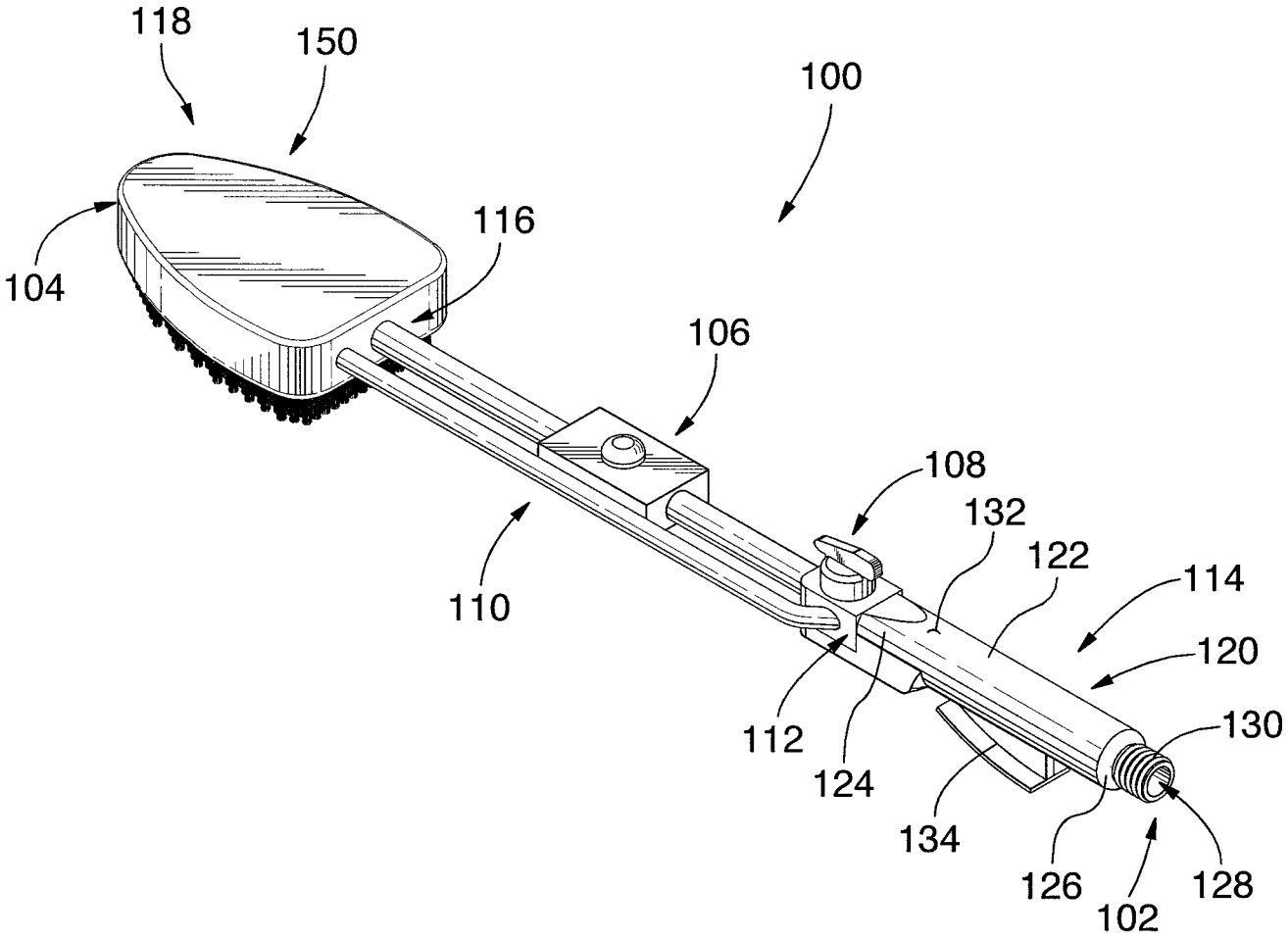
FIG. 1 is a drawing showing a perspective view of a water-saver cleaning device in accordance with a first embodiment of the present invention.

Now referring to FIG. 1, there is shown a first embodiment of a cleaning device 100 to be connected to a water hose, not shown. The cleaning device 100 may be used, for instance, to clean an object such as a vehicle.

In an alternative embodiment, the object to be cleaned using the cleaning device 100 may comprise a structure such as a fence or the like. In yet another embodiment, the object to be cleaned using the cleaning device 100 may comprise a deck such as an outdoor deck. In yet another embodiment, the object to be cleaned using the cleaning device 100 may comprise an animal such as a horse, a cow or the like. In yet another embodiment, the object to be cleaned using the cleaning device 100 may comprise patio furniture such as a patio chair, a patio table or the like.

It will be appreciated by the skilled addressee that any object requiring cleaning may be cleaned using the cleaning device 100 herein described.

Water is provided to the cleaning device 100 from the water hose, not shown, through a water inlet 102 provided at a first end of the cleaning device 100, the water inlet 102 being provided for receiving the water hose, not shown.

The skilled addressee will appreciate that water may be substituted for any other liquid one may see fit for the use of the present invention. In an alternative embodiment, a liquid mixture of water and disinfectant such as an alcohol-based disinfectant, an aldehyde-based disinfectant, an oxidizing agent-based disinfectant or the like may be provided to the cleaning device 100.

The cleaning device 100 is further provided with an outlet assembly 150 for dispensing water therefrom and a brush 104 located at a first end of the outlet assembly 150, the brush 104 conferring improved cleaning abilities to the cleaning device 100.

The cleaning device 100 further comprises a cleaning mixture reservoir 106 in fluid communication with the outlet assembly 150 used for storing and selectively dispensing an amount of cleaning mixture through the outlet assembly 150, the cleaning mixture being used to further improve the cleaning abilities of the cleaning device 100, as it will become apparent below.

The cleaning device 100 is further provided with a flow selection assembly operatively coupled to the water inlet 102, the outlet assembly 150 and the cleaning mixture reservoir 106, the flow selection assembly comprising a switch assembly 108 for switching between a water and cleaning mixture dispensing mode wherein the water inlet 102 is in fluid communication with the cleaning mixture reservoir 106 and the outlet assembly 150 and the water is dispensed at a first given flow rate and a cleaning mode wherein the water inlet 102 is in fluid communication with the outlet assembly 150 and the water is dispensed at a second given flow rate greater than the first given flow rate, as it will become apparent below.

Figure 2A:
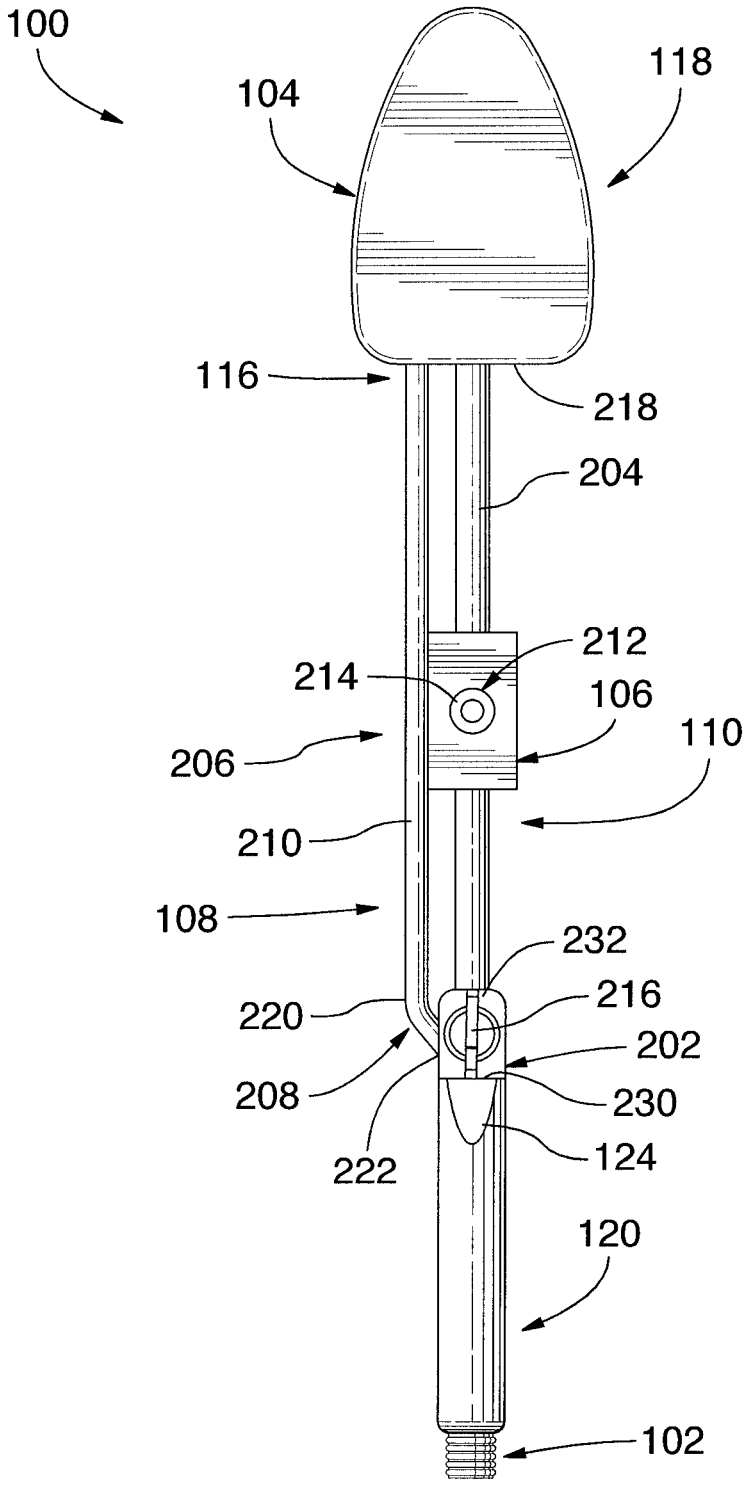
FIG. 2A is a drawing showing a back elevation view of the water-saver cleaning device shown in FIG. 1.
Figure 2B:
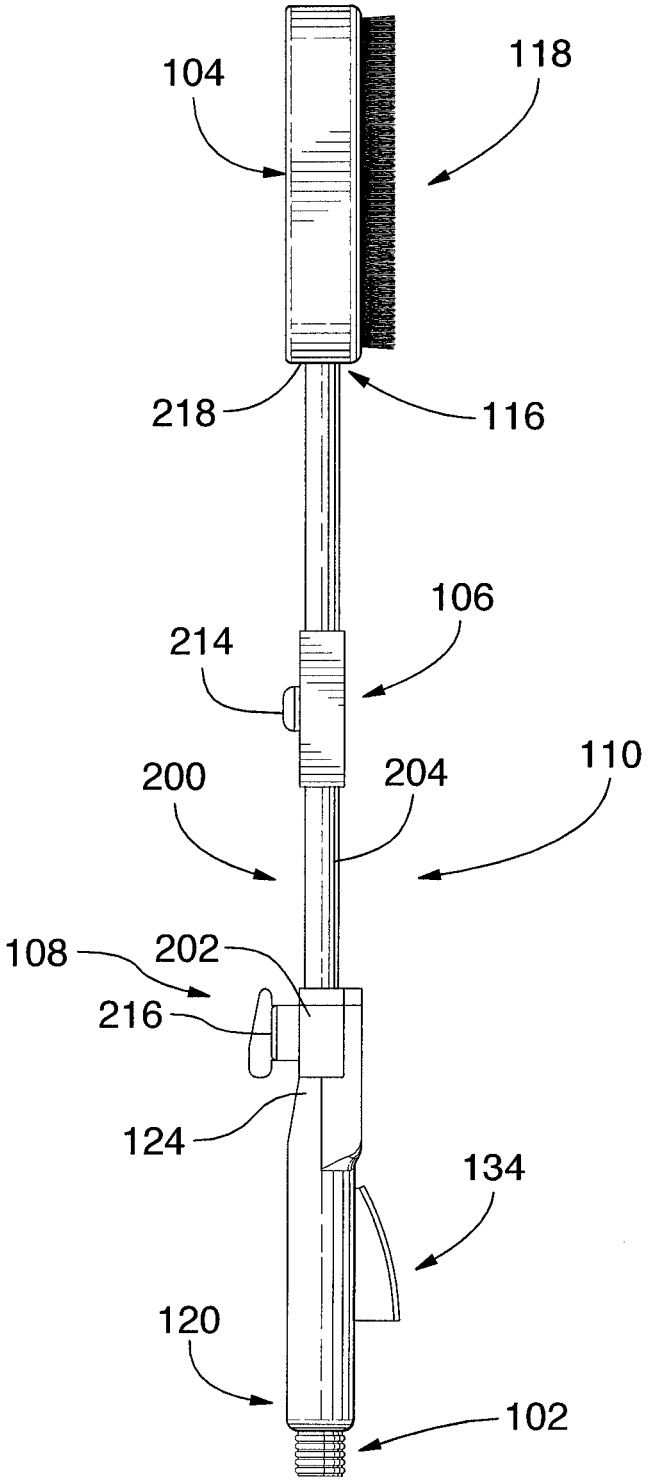
FIG. 2B is a drawing showing a left side elevation view of the water-saver cleaning device shown in FIG. 1.

The features of the cleaning device 100 will now be detailed in accordance with a first embodiment of the present invention, with references to FIGS. 1, 2A and 2B.

The cleaning device 100 comprises a central switching portion 110 having a first central switching portion handling end 112 wherefrom extends outwardly and axially a handling portion 114 and a second, opposite central switching portion cleaning end 116 wherefrom extends outwardly a cleaning portion 118.

The handling portion 114 comprises a handle 120 used to handle the cleaning device 100 using a hand. The handle 120 comprises a generally cylindrical hollow body 122 having a switching end 124 and an inlet end 126 whereat the water inlet 102 is located. The handle 122 further comprises a handle conduit 128 extending inwardly and concentrically from the inlet end 126, the handle conduit 128 being in fluid communication with the water hose, not shown.

In the embodiment shown in FIG. 1, the water inlet 102 comprises an externally threaded cylindrical inlet connector 130 extending axially and outwardly from the inlet end 126, the externally threaded cylindrical inlet connector 130 being adapted to threadily engage a corresponding water hose internally threaded portion, not shown.

In an alternative embodiment, the water inlet 102 does not comprise an externally threaded cylindrical inlet connector 130. In such an embodiment, the handle conduit 128 comprises a handle conduit internally threaded portion, not shown, adapted for threadily receiving a corresponding water hose externally threaded portion, not shown, therein.

In yet another embodiment, the water inlet 102 does not comprise an externally threaded cylindrical inlet connector 130. In such an embodiment, the water inlet 102 comprises a quick disconnect fitting known to the skilled addressee adapted for engaging a corresponding quick disconnect fitting provided with the water hose.

In a preferred embodiment, the handle 120 is provided with a handle gripping surface 132 to provide a better grip for a hand using the cleaning device 100. In an alternative embodiment, the handle 120 is not provided with a handle gripping surface 132. In yet another embodiment, the handle 120 may have a shape generally corresponding to the inside of a hand to prevent movement of the handle 120 in reference to a hand closed therearound.

The skilled addressee will appreciate that the handle gripping surface 132 may be made from a material such as rubber, foam or the like.

It will be appreciated by the skilled addressee that various designs may be provided for the handle 120 according to aesthetic considerations. Furthermore, the handle 120 may be manufactured from a light rigid material selected from a group comprising polyvinyl chloride, polypropylene, acrylonitrile butadiene styrene, polycarbonate or any other material the skilled addressee may deem appropriate for the present use of the invention.

Figure 3A:
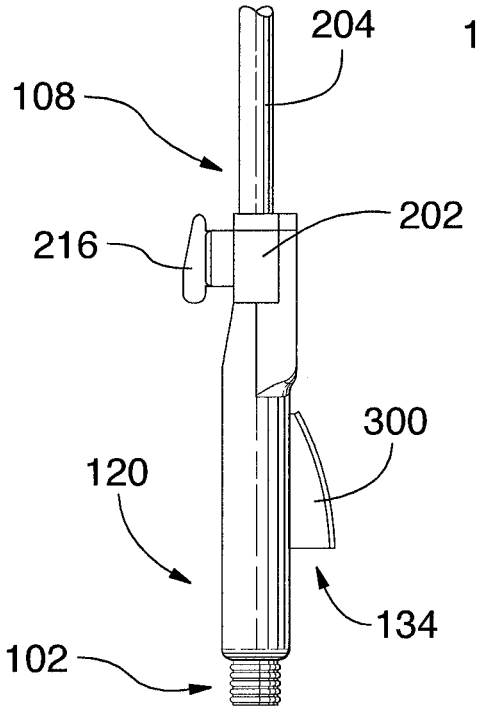
FIG. 3A is a drawing showing a left side elevation view of a handle for the water-saver cleaning device shown in FIG. 1, in accordance with one embodiment of the present invention.
Figure 3B:
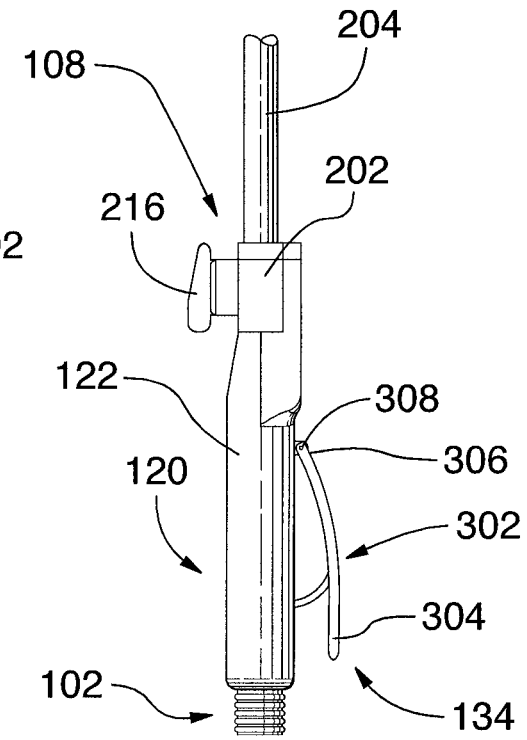
FIG. 3B is a drawing showing a left side elevation view of a handle for the water-saver cleaning device shown in FIG. 1, in accordance with an alternative embodiment of the present invention.

The handle 120 is further provided with an actuation mechanism 134, best shown in FIGS. 3A and 3B, for selectively enabling or preventing the passage of water through the handle conduit 128.

Now referring to FIG. 3A, according to one embodiment of the present invention, the actuation mechanism 134 comprises a depressible lever 300 adapted to be easily actuated by at least one finger of a hand holding the handle 120. The depressible lever 300 is used to selectively move a check valve, not shown, between an open position wherein water is dispensed from the water inlet 102 to the switch assembly 108 through the handle conduit 128, not shown in FIG. 3A, and a closed position wherein dispensing of water from the water inlet 102 to the switch assembly 108 through the handle conduit 128, not shown in FIG. 3A, is prevented.

Now referring to FIG. 3B, according to an alternative embodiment of the present invention, the actuation mechanism 134 comprises a hinged lever 302 having a first grasping end 304 adapted to be grasped by at least one finger of a hand holding the handle 120 and a second, opposite hinge end 306 hingedly connected to the hollow body 122 of the handle 120 using a hinge 308. The hinged lever 302 is used to selectively move a check valve, not shown, between an open position wherein water is dispensed from the water inlet 102 to the switch assembly 108 through the handle conduit 128, not shown in FIG. 3B, and a closed position wherein dispensing of water from the water inlet 102 to the switch assembly 108 through the handle conduit 128, not shown in FIG. 3B, is prevented.

Now referring back to FIGS. 2A and 2B, the central switching portion 110 comprises a switch assembly 108. More specifically, the switch assembly 108 comprises a hollow water routing casing 202 extending outwardly and axially from the switching end 124 of the handle 120, the hollow water routing casing 202 having a first hollow water routing casing entry end 230 and a second, opposite hollow water routing casing dispensing end 232. The hollow water routing casing 202 comprises an entry port, not shown in FIGS. 2A and 2B, located at the hollow water routing casing entry end 230, the entry port, not shown in FIGS. 2A and 2B, being in fluid communication with the water inlet 102 through the handle conduit 128, not shown in FIGS. 2A and 2B, as it will become apparent below.

Still in a first embodiment of the present invention shown in FIGS. 1, 2A and 2B, the switch assembly 108 further comprises a rigid water and cleaning mixture dispensing tube 204 extending outwardly and axially between a water and cleaning mixture dispensing port, not shown in FIG. 2B, located at the hollow water routing casing dispensing end 232 and the outlet assembly 150. More specifically, the water and cleaning mixture dispensing tube 204 extends linearly between the hollow water routing casing dispensing end 232 and the central switching portion cleaning end 116 of the central switching portion 110.

It will be appreciated by the skilled addressee that a linearly extending rigid water and cleaning mixture dispensing tube 204 enables a user to clean an object placed at some distance from a hand holding the handle of the cleaning device 100. In an alternative embodiment, the rigid water and cleaning mixture dispensing tube 204 may be curved to enable a user to clean hard-to-reach objects such as the roof of an elevated vehicle.

In yet another embodiment, the water and cleaning mixture dispensing tube 204 may be bendable such that it retains an assigned shape, enabling a user to selectively straighten the water and cleaning mixture dispensing tube 204 to clean a distant object or bend the water and cleaning mixture dispensing tube 204 to clean a hard-to-reach object using the cleaning device 100.

The central switching portion 110 further comprises a cleaning mixture reservoir 106 wherethrough extends the water and cleaning mixture dispensing tube 204, as it will become apparent below.

The cleaning mixture reservoir 106 is provided with a cleaning mixture reservoir opening 212 used to provide cleaning mixture into the cleaning mixture reservoir 106. The cleaning mixture reservoir 106 is further provided with a removable cleaning mixture reservoir cap 214 such as a screw cap or the any other type of cap known to the skilled addressee.

It will be appreciated by the skilled addressee that removal of the removable cleaning mixture reservoir cap 214 from the cleaning mixture reservoir 106 enables access to the inside of the cleaning mixture reservoir 106 through the cleaning mixture reservoir opening 212 for the purpose of providing cleaning mixture into the cleaning mixture reservoir 106.

In an alternative embodiment, the cleaning mixture reservoir 106 does not comprise a cleaning mixture reservoir opening 212. In such an embodiment, the cleaning mixture reservoir 106 instead comprises a removable capsule containing an amount of cleaning mixture, the removable capsule being in fluid communication with a stationary cleaning mixture reservoir base in fluid communication with the water and cleaning mixture dispensing tube 204. The removable capsule containing an amount of cleaning mixture may be removed from the cleaning mixture reservoir 106 and replaced by a similar removable capsule containing a greater amount of cleaning mixture.

Preferably, the cleaning mixture reservoir 106 contains Ultra Soap 2500 cleaning mixture from Raindance Water Systems. The skilled addressee will appreciate that any other cleaning mixture mixable with water may be alternately used.

The skilled addressee will appreciate that the cleaning mixture reservoir 106 may be manufactured from a light impermeable material selected from a group comprising polyvinyl chloride, polypropylene, acrylonitrile butadiene styrene, polyethylene, polycarbonate or any other material the skilled addressee may deem appropriate for the present use of the invention.

Still in a first embodiment of the present invention shown in FIGS. 1, 2A and 2B, the central switching portion 110 further comprises a water dispensing tube 206 extending between a water dispensing port, not shown in FIGS. 2A and 2B, located on the left side of the hollow water routing casing 202 and the outlet assembly 150, the water dispensing tube 206 being positioned in a side by side relationship with the water and cleaning mixture dispensing tube 204. More specifically, the water dispensing tube 206 comprises a water dispensing tube elbow 208 having a first elbow end 222 sealingly connected to the water dispensing port, not shown in FIGS. 2A and 2B, wherefrom the water dispensing tube elbow 208 extends outwardly and leftwardly, curving towards the cleaning portion 118 of the cleaning device 100.

The water dispensing tube 204 further comprises a water dispensing tube straight portion 210 extending parallel to the water and cleaning mixture dispensing tube 204, between a second elbow end 220 of the water dispensing tube elbow 208 and the central switching portion cleaning end 116 of the central switching portion 110.

It will be appreciated by the skilled addressee that the position of the water dispensing tube 206 in reference to the water and cleaning mixture dispensing tube 204 may be different. In another embodiment, the water dispensing tube 206 may be positioned on the right side of the water and cleaning mixture dispensing tube 204. In yet another embodiment, the water dispensing tube 206 may be positioned underneath the water and cleaning mixture dispensing tube 204.

It will further be appreciated by the skilled addressee that the position of the water and cleaning mixture dispensing tube 204 and the water dispensing tube 206 may be interchanged.

Now referring to FIG. 2B, the switch assembly 108 further comprises a switch mounted on top of the hollow water routing casing 202. More specifically, the switch comprises a hollow rotatable switch 216 selectively rotating on the top surface of the hollow water routing casing 202 between a water and cleaning mixture dispensing position wherein the switch assembly 108 is in water and cleaning mixture dispensing mode and a water dispensing position wherein the switch assembly 108 is in cleaning mode, as it will become apparent below.

In an alternative embodiment, the switch does not comprise a hollow rotatable switch 216. The switch instead comprises a translatable switch, not shown, selectively translating between a water and cleaning mixture dispensing position wherein the switch assembly 108 is in water and cleaning mixture dispensing mode and a water dispensing position wherein the switch assembly 108 is in cleaning mode.

Still referring to FIG. 2B, the cleaning portion 118 comprises the outlet assembly 150, the outlet assembly 150 being provided with a brush 104.

More specifically, the brush 104 comprises an underside brush face 218 generally facing towards the central switching portion 110, whereon are located ports for receiving therein the water and cleaning mixture dispensing tube 204 and the water dispensing tube 206 extending from the central switching portion 110 of the cleaning device 100, the brush 104 being in fluid communication with the water and cleaning mixture dispensing tube 204 and the water dispensing tube 206 extending from the central switching portion 110.

The skilled addressee will appreciate that the water and cleaning mixture dispensing tube 204, the water dispensing tube 206, the switch assembly 108 and the brush 104 may be manufactured from a light, impermeable rigid material selected from a group comprising polyvinyl chloride, polypropylene, acrylonitrile butadiene styrene, polycarbonate or any other material the skilled addressee may deem appropriate for the present use of the invention.

Figure 4:
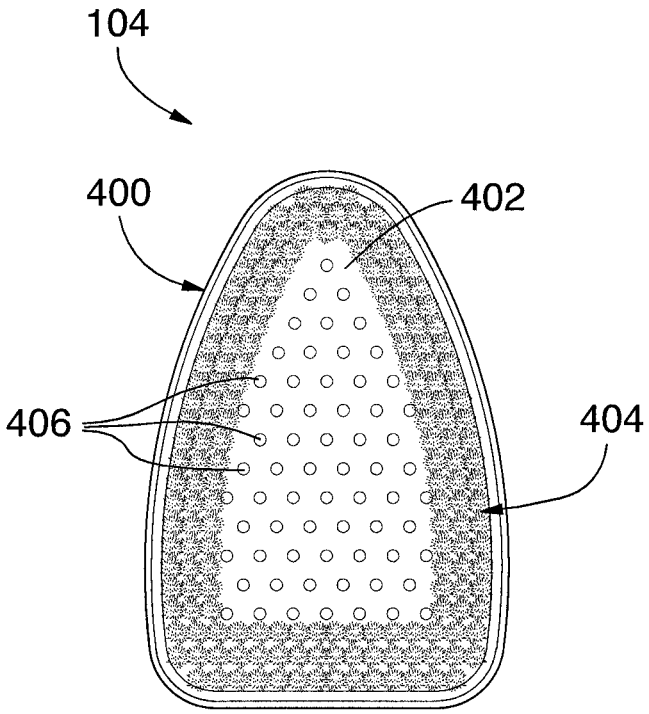
FIG. 4 is a drawing showing a front elevation view of a brush for the water-saver cleaning device shown in FIG. 1.

Now turning to FIG. 4, there is shown a brush 104 according to a first embodiment of the present invention. The brush 104 comprises a hollow brush body 400 having a water dispensing brush face 402 wherefrom a set of bristles 404 extends outwardly and generally perpendicularly.

The skilled addressee will appreciate that the bristles 404 may be manufactured from a fibrous material such as nylon, animal hair or the like.

The water dispensing brush face 402 further comprises a plurality of water dispensing openings 406 for dispensing water onto an object to be cleaned. More specifically, water provided to the outlet assembly 150, is dispensed on an object to be cleaned through the water dispensing openings 406.

While a given pattern for the plurality of water dispensing openings 406 and a given pattern for the set of bristles 404 are disclosed in FIG. 4, the skilled addressee will appreciate that various other types of patterns may be provided alternatively.

Figure 5A:
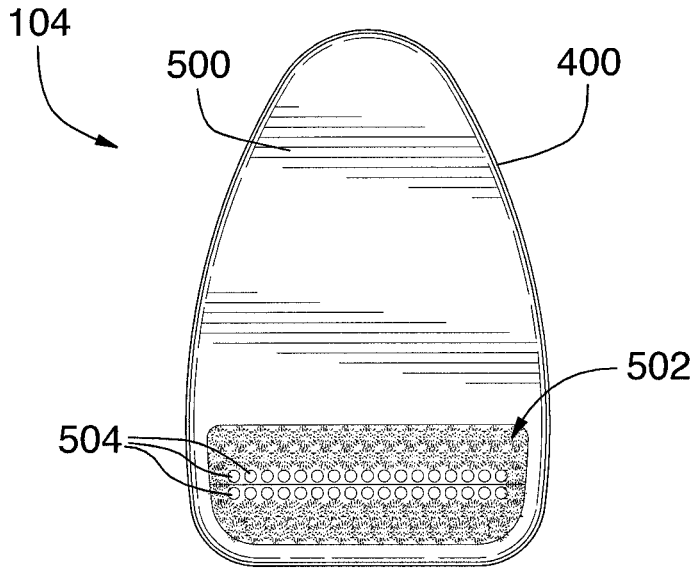
FIG. 5A is a drawing showing a back elevation view of a brush for a water-saver cleaning device in accordance with an alternative embodiment of the present invention.
Figure 5B:
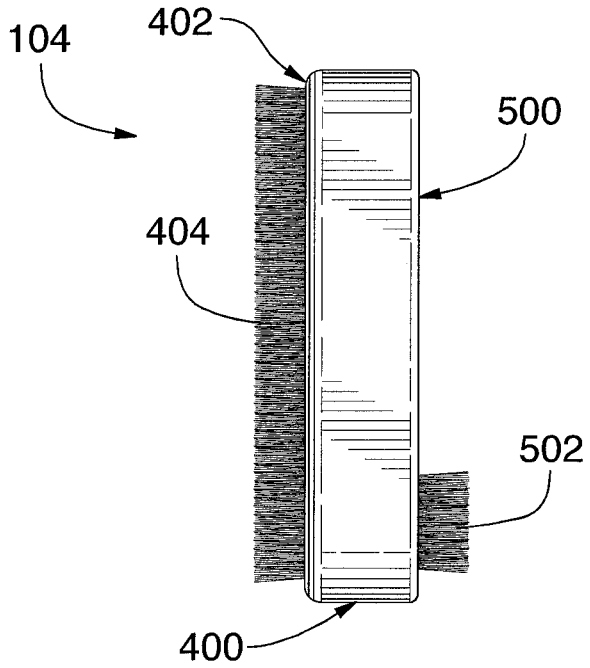
FIG. 5B is a drawing showing a right elevation view of the brush for a water-saver cleaning device shown in FIG. 5A.

Now referring to FIGS. 5A and 5B, there is shown a brush 104 according to an alternative embodiment of the present invention. In such an embodiment, the brush 104 comprises a water and cleaning mixture dispensing brush face 500 opposite to the water dispensing face 402. The water and cleaning mixture dispensing brush face 500 is provided with a second set of bristles 502 extending outwardly and generally perpendicularly therefrom and with water and cleaning mixture dispensing openings 504. In such an embodiment, the water dispensing openings 406 of the brush 104 are in fluid communication with the water dispensing tube 206 while the cleaning mixture dispensing openings 504 are in fluid communication with the water and cleaning mixture dispensing tube 204.

This embodiment would allow the bristles 404 on the water dispensing brush face 402 to remain free of cleaning mixture. This would be desirable in a cleaning operation where a user would successively dispense water and cleaning mixture on a first object and water without cleaning mixture on a second object.

It will be appreciated by the skilled addressee that the brush 104 may be slightly angled backwards in reference to the water and cleaning mixture dispensing tube 204 such that the brush 104 may be placed parallel over a surface of a object to be cleaned while enabling a hand holding the handle 120 of the cleaning device 100 to clear the surface of the object to be cleaned.

The skilled addressee will further appreciate that various designs may be provided for the brush 104 and aesthetics considerations may be taken in consideration when providing the brush 104.

Figure 6:
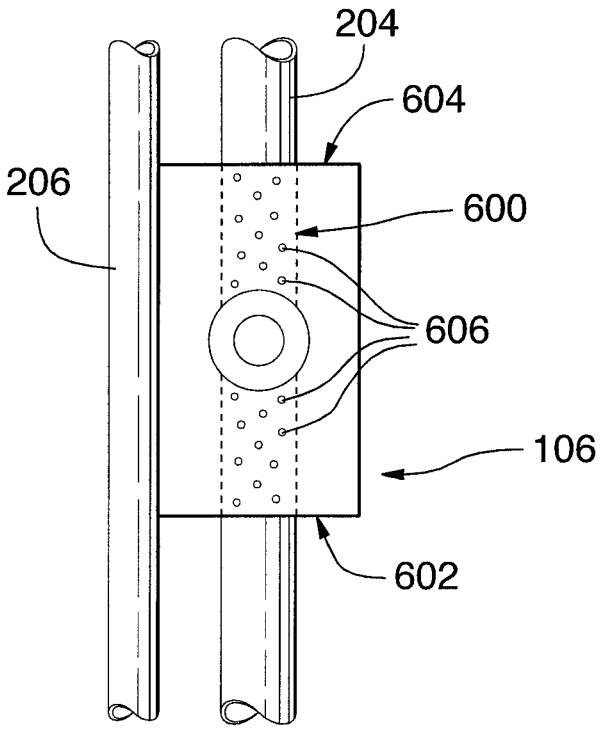
FIG. 6 is a drawing showing an enlarged back elevation view of a water-saver cleaning mixture dispensing reservoir for the water-saver cleaning device shown in FIG. 1.

Now referring to FIG. 6, there is shown an enlarged view of a portion of the central switching portion 110 of the cleaning device 100. As shown in FIG. 6, the water and cleaning mixture dispensing tube 204 comprises a water and cleaning mixture dispensing tube enclosed portion 600 enclosed in the cleaning mixture reservoir 106 between a first cleaning mixture reservoir wall 602 and a second, opposite cleaning mixture reservoir wall 604 of the cleaning mixture reservoir 106.

The water and cleaning mixture dispensing tube enclosed portion 600 is further provided with a plurality of openings 606 used in order to mix water circulating in the water and cleaning mixture dispensing tube 204 and cleaning mixture contained in the cleaning mixture reservoir 106. The skilled addressee will appreciate that the openings 606 are designed to provide a predetermined amount of cleaning mixture desired for a cleaning operation. Therefore, the size of the openings 606 is adjusted according to the flow rate of water being dispensed through the water and cleaning mixture dispensing tube 204.

Figure 7:
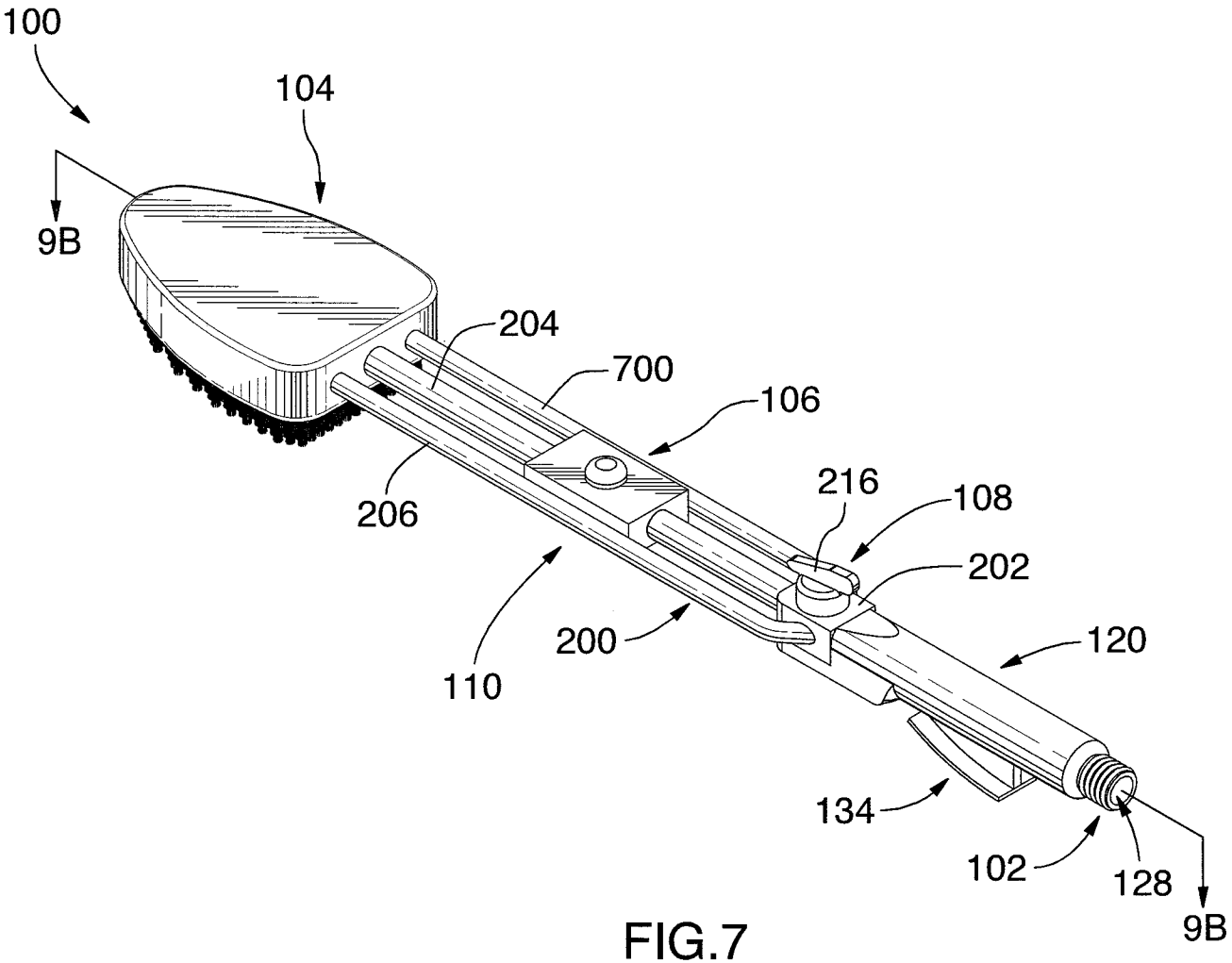
FIG. 7 is a drawing showing a perspective view of a water-saver cleaning device in accordance with a second embodiment of the present invention.
Figure 8:
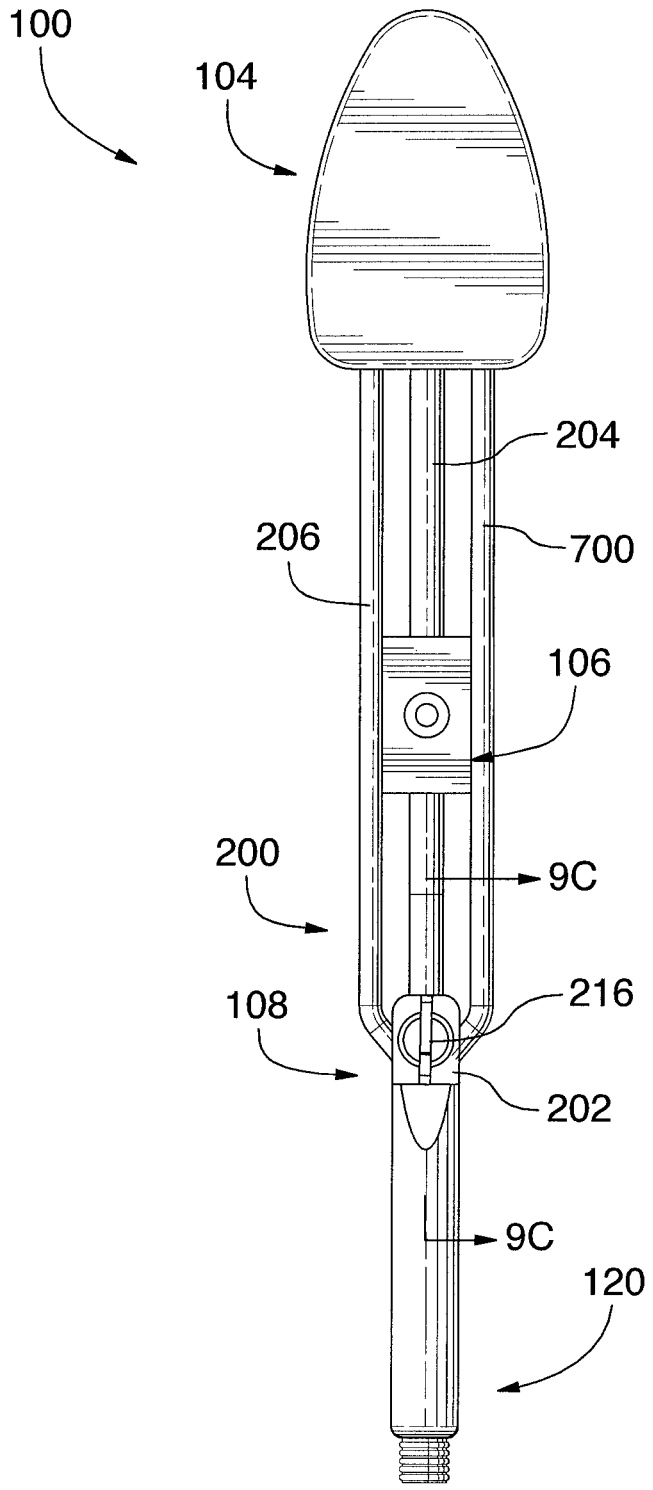
FIG. 8 is a drawing showing a back elevation view of the water-saver cleaning device shown in FIG. 7.

Now referring to FIGS. 7 and 8, there is shown a second embodiment of a water-saver cleaning device 100 to be connected to a water hose 102.

The cleaning device 100 according to the second embodiment of the present invention, as shown in FIG. 7, is generally similar to the first embodiment of cleaning device 100 as shown in FIG. 1, as previously described.

In such an embodiment, the cleaning mode of the switch assembly 108 comprises a first water dispensing mode wherein the water inlet 102 is in fluid communication with the outlet assembly 150 and water is dispensed at a first given flow rate and a second water dispensing mode wherein the water inlet 102 is in fluid communication with the outlet assembly 150 and water is dispensed at a second given flow rate greater than the first given flow rate.

In addition to the features previously described, the switch assembly 108 further comprises a second water dispensing tube 700 for providing water from the water inlet 102 to the outlet assembly 150 at a second given flow rate greater than the first water dispensing tube 206.

Still referring to FIG. 7, the second water dispensing tube 700 extends between a second water dispensing port, not shown in FIG. 7, and the outlet assembly 150. More specifically, the second water dispensing tube 700 is positioned in a side by side relationship with the water and cleaning mixture dispensing tube 204.

It will be appreciated that the second water dispensing tube 700 is a mirror image of the first water dispensing tube 206 over a symmetry axis corresponding to the axis of the water and cleaning mixture dispensing tube 204, and thus requires no further description.

In one embodiment, the cleaning device 100 is manufactured by assembling the water inlet 102, the outlet assembly 150, the cleaning mixture reservoir 106 and the flow selection assembly using an assembling method such as gluing, friction welding, thermoforming or the like. In an alternative embodiment, the cleaning device 100 may be manufactured using a process of molding such as injection molding or the like.

Having described the features of the present invention in accordance with a first embodiment and second embodiment, its operation will now be described with references to FIG. 7, in accordance with the second embodiment of the present invention.

Cleaning mixture is first provided inside the cleaning mixture reservoir 106 through the cleaning mixture reservoir opening 212 and the cleaning mixture reservoir cap 214 is secured over the cleaning mixture reservoir opening 212. The water inlet 102 of the cleaning device 100 is then connected to a water hose, not shown, wherefrom water is provided to the cleaning device 100 through the water inlet 102. The brush 104 is then positioned near an object to be cleaned, the water dispensing openings 406, not shown in FIG. 7, facing towards the object.

When the actuation mechanism 134 is activated, water enters the handle conduit 128 of the handle 120 from the water hose, not shown, and proceeds to the hollow water routing casing 202 through the entry port, not shown in FIG. 7.

Figure 9A:
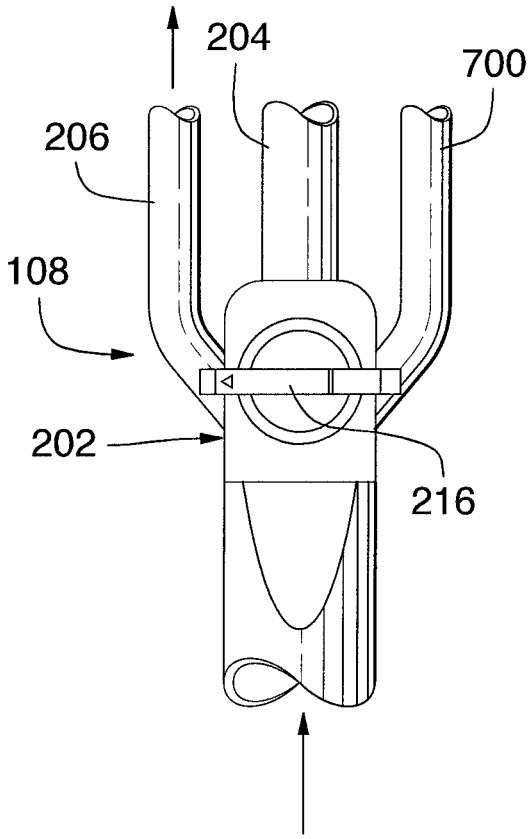
FIG. 9A is a drawing showing an enlarged back elevation view of a switch assembly for the water-saver cleaning device shown in FIG. 7, according to one embodiment of the present invention.
Figure 9B:
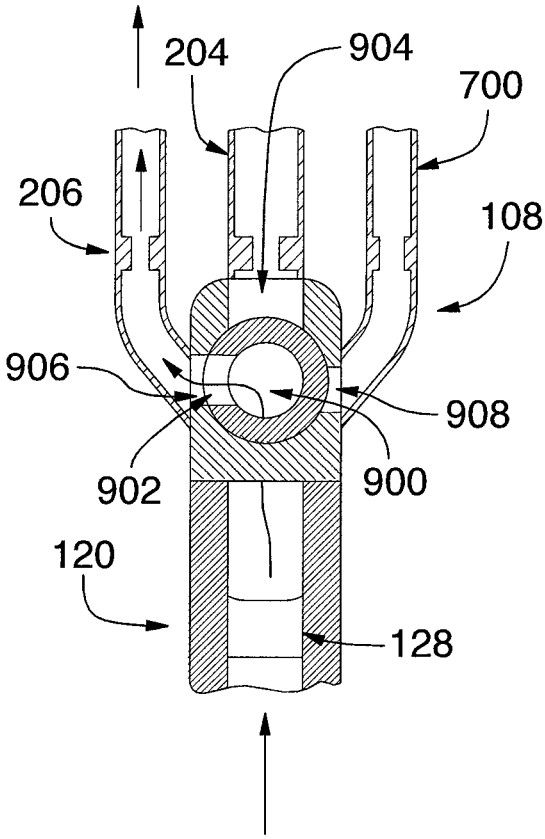
FIG. 9B is a drawing showing a cross-section view of the switch assembly shown in FIG. 9A taken along cross section line 9B-9B of FIG. 7.
Figure 9C:
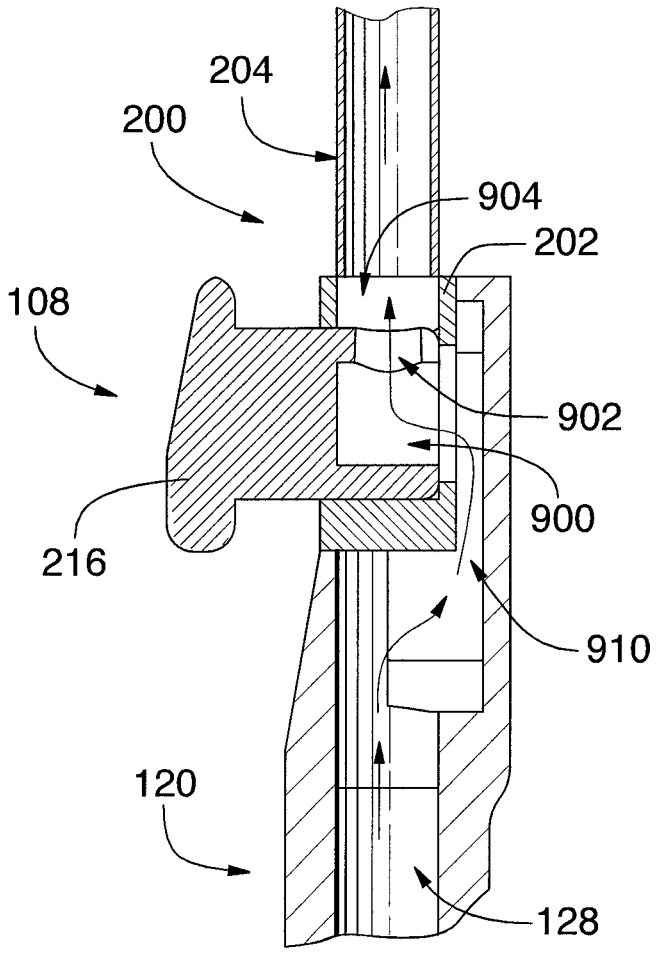
FIG. 9C is a drawing showing a cross-section view of the switch assembly shown in FIG. 9A taken along cross section line 9C-9C of FIG. 8.

Now referring to FIGS. 9A to 9C, the hollow water routing casing 202 comprises a water and cleaning mixture dispensing port 904 located at the hollow water routing casing dispensing end 232, the water and cleaning mixture dispensing port 904 being in fluid communication with the entry port 910 when the switch assembly 108 is in water and cleaning mixture dispensing mode, as it will become apparent below.

Still referring to FIGS. 9A to 9C, the hollow water routing casing 202 further comprises a water dispensing port 906 located on the left side of the hollow water routing casing 202, the water dispensing port 906 being in fluid communication with the entry port 910 when the switch assembly 108 is in cleaning mode, as it will become apparent below.

According to the second embodiment of the invention shown in FIG. 7, the hollow water routing casing 202 further comprises a second water dispensing port 908 located on the left side of the hollow water routing casing 202, the water dispensing port 908 being in fluid communication with the entry port 910 when the switch assembly 108 is in cleaning mode, as it will become apparent below.

Water travels from the hollow water routing casing 202 towards the outlet assembly 150 according to the position of the hollow rotatable switch 216. The hollow rotatable switch 216 has a water and cleaning mixture dispensing position, a first water dispensing position and a second water dispensing position respectively corresponding to the water and cleaning mixture dispensing mode, the first water dispensing mode and the second water dispensing mode of the switch assembly 108.

The hollow rotatable switch 216 comprises a rotatable switch recess 900 and a water communication opening 902 for providing fluid communication between the handle conduit 128 and one of the tubes of the central switching portion 110 extending from the hollow water routing casing 202, as it will become apparent below. The hollow rotatable switch 216 may be rotated to move the switch assembly 108 from one mode to the other.

In a water and cleaning mixture dispensing mode, the hollow rotatable switch 216 is angularly positioned such that the water communication opening 902 provides fluid communication between the entry port 910 and the water and cleaning mixture dispensing tube 204 through the water and cleaning mixture dispensing port 904. Water travels from the hollow water routing casing 202 through the water and cleaning mixture dispensing tube 204 towards the outlet assembly 150, not shown in FIGS. 9A to 9C.

Cleaning mixture is mixed with water as it passes through the water and cleaning mixture dispensing tube enclosed portion 600, before reaching the outlet assembly 150 wherefrom it is dispensed at a first given flow rate through the water dispensing openings 406 of the brush 104 onto an object to be cleaned.

In a first water dispensing mode, the hollow rotatable switch 216 is angularly positioned such that the water communication opening 902 provides fluid communication between the entry port 910 and the water dispensing tube 206 through the first water dispensing port 906. Water travels from the hollow water routing casing 202 through the water dispensing tube 206 towards the outlet assembly 150 wherefrom it is dispensed from the water dispensing openings 406 of the brush 104 onto an object to be cleaned.

In a second water dispensing mode, the hollow rotatable switch 216 is angularly positioned such that the knob water communication opening 902 provides fluid communication between the entry port 910 and the second water dispensing tube 700 through the second water dispensing port 908. Water travels from the hollow water routing casing 202 through the second water dispensing tube 700 towards the outlet assembly 150 wherefrom it is dispensed from the water dispensing openings 406 of the brush 104 onto an object to be cleaned.

Figure 10A:
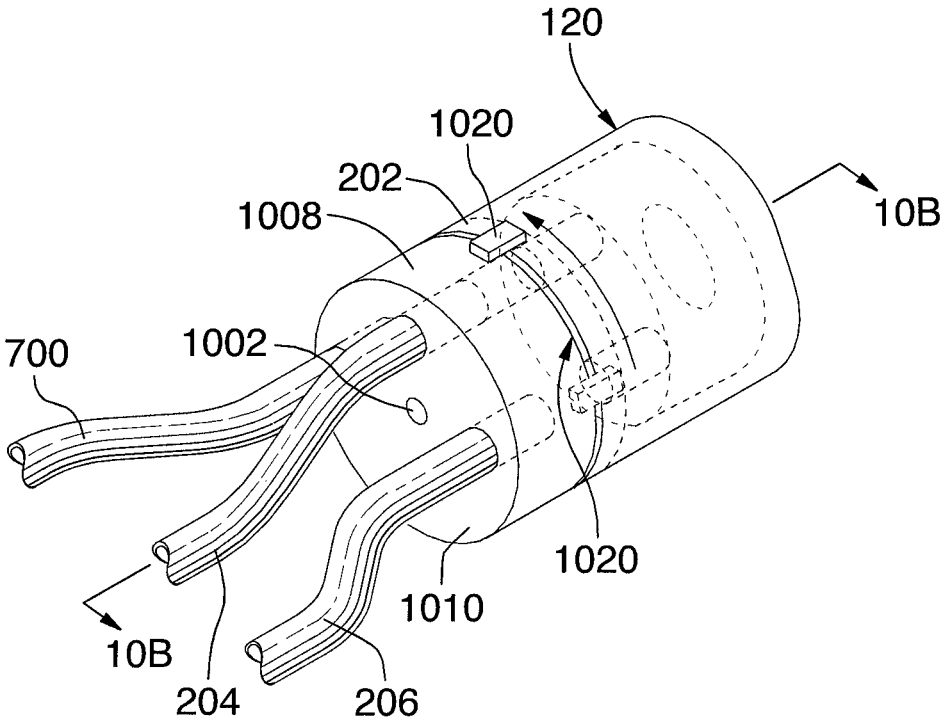
FIG. 10A is a drawing showing a perspective view of a switch assembly for a water-saver cleaning device according to an alternative embodiment of the present invention.
Figure 10B:
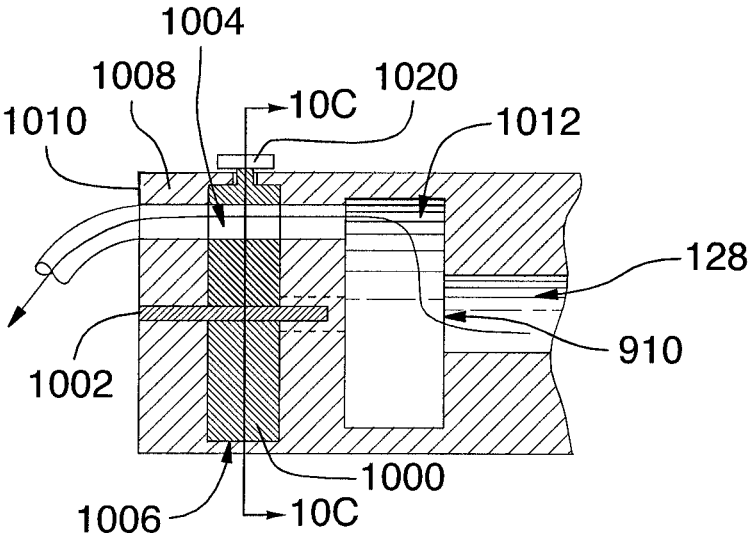
FIG. 10B is a cross-section view of the switch assembly shown in FIG. 10A taken along cross section line 10B-10B of FIG. 10A.
Figure 10C:
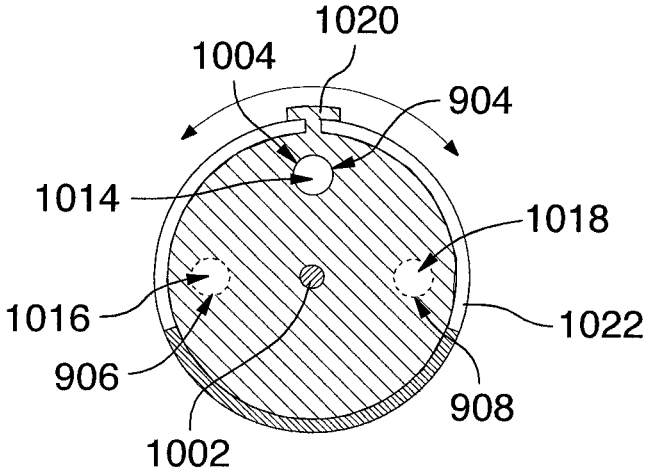
FIG. 10C is a cross-section view of the switch assembly shown in FIG. 10A taken along cross section line 10C-10C of FIG. 10B.

Now referring to FIGS. 10A to 10C, there is shown a switch assembly 108 according to an alternative embodiment of the present invention.

In such an embodiment, the switch comprises a rotatable switching disc 1000, as best shown in FIG. 10B, rotatively mounted on a central rotation axle 1002 parallel to the handle 120, the rotatable switching disc 1000 indexingly rotating around the central rotation axle 1002 between a water and cleaning mixture dispensing position wherein the hollow water routing casing 202 and the water and cleaning mixture dispensing tube 204 are in fluid communication, a first water dispensing position wherein the hollow water routing casing 202 and the first water dispensing tube 206 are in fluid communication and a second water dispensing position wherein the hollow water routing casing 202 and the second water dispensing tube 700 are in fluid communication.

More specifically, the rotatable switching disc 1000 comprises an off-centered cylindrical communication opening 1004 normally extending therethrough. The rotatable switching disc 1000 is mounted in a switching disc recess 1006 provided inside a switching disc mounting portion 1008 of the hollow water routing casing 202, the switching disc mounting portion 1008 having a switching disc mounting portion tube end 1010 whereon are located the water and cleaning mixture dispensing port 904, the first water dispensing port 906 and the second water dispensing port 908.

The hollow water routing casing 202 is further provided with a hollow casing internal cavity 1012 located between the handle conduit 128 and the switching disc mounting portion 1008, the hollow casing internal cavity 1012 being in fluid communication with the handle conduit 128 through the entry port 910.

The switching disc mounting portion 1008 is further provided with a water and cleaning mixture dispensing tube connecting hole 1014, a water dispensing tube connecting hole 1016 and a second water dispensing tube connecting hole 1018 extending parallel to the cylindrical communication opening 1004, between the hollow casing internal cavity 1012 and the water and cleaning mixture dispensing port 904, between the hollow casing internal cavity 1012 and the first water dispensing port 906 and between the hollow casing internal cavity 1012 and the second water dispensing port 908, respectively.

The water and cleaning mixture dispensing tube 204 is sealingly connected to the water and cleaning mixture dispensing port 904 such that the water and cleaning mixture dispensing tube 204 is in fluid communication with the water and cleaning mixture dispensing tube connecting hole 1014.

Similarly, the first water dispensing tube 206 is sealingly connected to the first water dispensing port 906 such that the water dispensing tube 206 is in fluid communication with the water dispensing tube connecting hole 1016.

Similarly, the second water dispensing tube 700 is sealingly connected to the second water dispensing port 908 such that the second water dispensing tube 700 is in fluid communication with the second water dispensing tube connecting hole 1018.

The rotatable switching disc 1000 is rotated using a sliding knob 1020 outwardly and radially extending therefrom. The sliding knob 1020 moves circumferentially along a switch assembly arced guide slit 1022 extending peripherally to the switching disc recess 1006 and perpendicularly to the central rotation axle 1002.

More specifically, the switch assembly arced guide slit 1022 extends over a portion of the switching disc recess 1006 such that the cylindrical communication opening 1004 may selectively be aligned with the water and cleaning mixture dispensing tube connecting hole 1014, the water dispensing tube connecting hole 1016 and the second water dispensing tube connecting hole 1018 by rotating the rotatable switching disc 1000.

The rotatable switching disc 1020 is adapted to be rotated using a finger of a hand holding the handle 120, the finger moving the sliding knob 1020 along the switch assembly arced guide slit 1022.

The skilled addressee will appreciate that various designs may be provided for the sliding knob 1020 in accordance with aesthetic and ergonomic considerations.

Now turning to FIG. 100, the skilled addressee will further appreciate that the water and cleaning mixture dispensing tube connecting hole 1014, the water dispensing tube connecting hole 1016 and the second water dispensing tube connecting hole 1018 are located at a same radial distance from the central rotation axle 1002 as the cylindrical communication opening 1004.

In a water and cleaning mixture dispensing mode, the rotatable switching disc 1000 is angularly positioned around the central rotation axle 1002 such that the cylindrical communication opening 1004 is aligned with the water and cleaning mixture dispensing tube connecting hole 1014, providing fluid communication between the hollow casing internal cavity 1012 and the water and cleaning mixture dispensing tube 204.

In a first water dispensing mode, the rotatable switching disc 1000 is angularly positioned around the central rotation axle 1002 such that the cylindrical communication opening 1004 is aligned with the water dispensing tube connecting hole 1016, providing fluid communication between the hollow casing internal cavity 1012 and the water dispensing tube 206.

In a second water dispensing mode, the rotatable switching disc 1000 is angularly positioned around the central rotation axle 1002 such that the cylindrical communication opening 1004 is aligned with the second water dispensing tube connecting hole 1018, providing fluid communication between the hollow casing internal cavity 1012 and the second water dispensing tube 700.

Figure 11A:
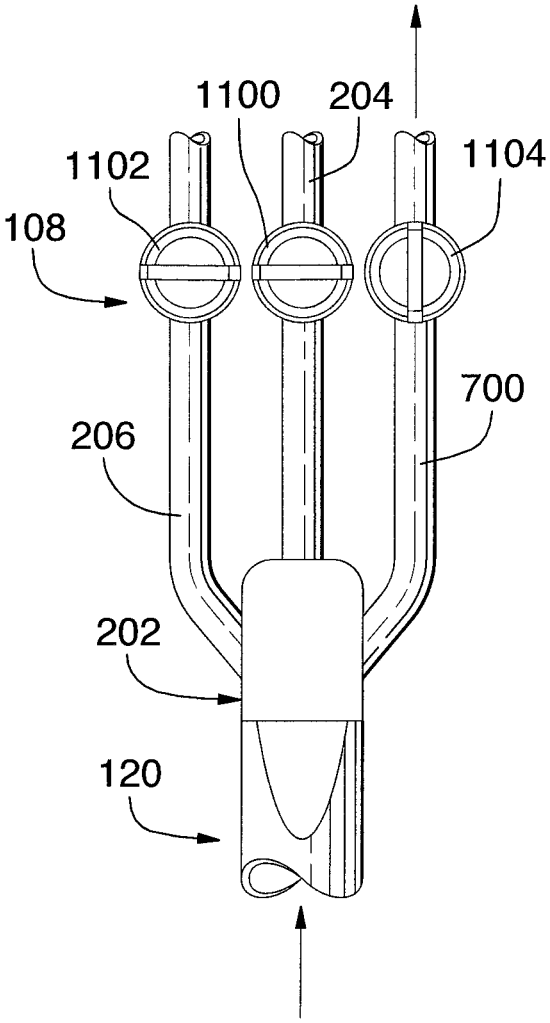
FIG. 11A is a drawing showing an enlarged back elevation view of a switch assembly for a water-saver cleaning device according to an alternative embodiment of the present invention.
Figure 11B:
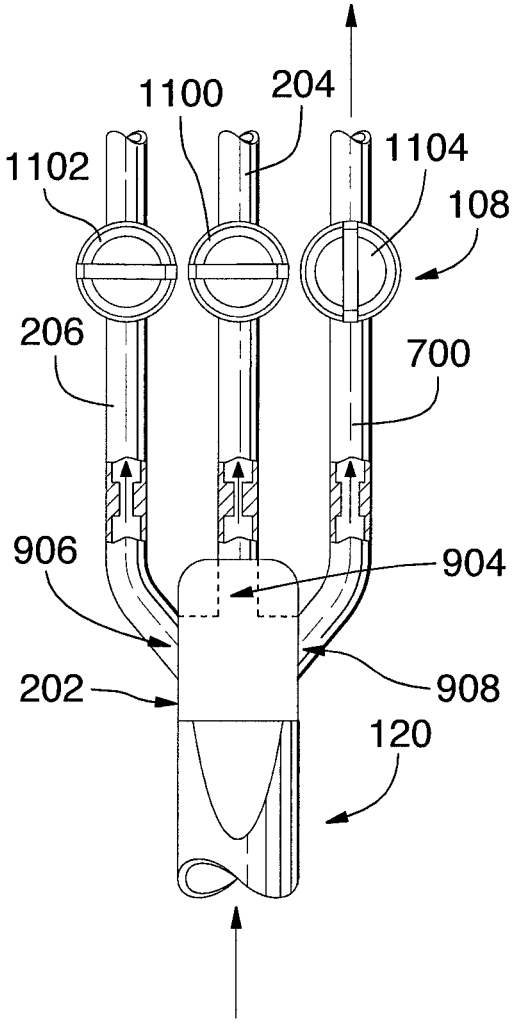
FIG. 11B is a drawing showing an enlarged, partially sectioned back elevation view of the switch assembly for a water-saver cleaning device shown in FIG. 11A.

Now turning to FIGS. 11A and 11B, there is shown a switch assembly 108 according to yet another embodiment of the present invention. In such an embodiment, the switch assembly 108 comprises three switches corresponding to the three modes of operation of the cleaning device 100.

More specifically, the switch assembly 108 comprises a water routing assembly 1106 operatively coupled to the water inlet 102, not shown in FIGS. 11A and 11B, through the handle conduit 128, not shown in FIGS. 11A and 11B. In the embodiment shown in FIGS. 11A and 11B, the water routing assembly 1106 comprises the hollow water routing casing 202.

The switch assembly 108 further comprises a water and cleaning mixture dispensing switch 1100 operatively coupled to the water and cleaning mixture dispensing tube 204. The water and cleaning mixture dispensing switch 1100 selectively moves between an open position wherein water is dispensed from the water and cleaning mixture dispensing port 904 to the outlet assembly 150 when water enters the cleaning device 100 through the water inlet 102 and a closed position wherein dispensing of water from the water and cleaning mixture dispensing port 904 to the outlet assembly 150 is prevented.

The switch assembly 108 further comprises a first water dispensing switch 1102 operatively coupled to the first water dispensing tube 206. The first water dispensing switch 1102 selectively moves between an open position wherein water is dispensed from the first water dispensing port 906 to the outlet assembly 150 when water enters the cleaning device 100 through the water inlet 102 and a closed position wherein dispensing of water from the first water dispensing port 906 to the outlet assembly 150 is prevented.

The switch assembly 108 further comprises a second water dispensing switch 1104 operatively coupled to the second water dispensing tube 700. The first water dispensing switch 1104 selectively moves between an open position wherein water is dispensed from the second water dispensing port 908 to the outlet assembly 150 when water enters the cleaning device 100 through the water inlet 102 and a closed position wherein dispensing of water from the second water dispensing port 908 to the outlet assembly 150 is prevented.

The skilled addressee will appreciate that the advantage of the three modes of operation is fully exploited when one valve is in an open position at a time.

The water and cleaning mixture dispensing mode of the switch assembly 108 is achieved when the water and cleaning mixture dispensing switch 1100 is in an open position and the first water dispensing switch 1102 and the second water dispensing switch 1104 are in a closed position.

Similarly, the first water dispensing mode of the switch assembly 108 is achieved when the first water dispensing switch 1102 is in an open position and the water and cleaning mixture dispensing switch 1100 and the second water dispensing switch 1104 are in a closed position.

Similarly, the second water dispensing mode of the switch assembly 108 is achieved when the second water dispensing switch 1104 is in an open position and the water and cleaning mixture dispensing switch 1100 and the first water dispensing switch 1102 are in a closed position.

It will further be appreciated by the skilled addressee that a thorough cleaning of an object using the cleaning device 100 is achieved by an advantageous combination of the three modes of operation. For instance, a user may first use the second water dispensing mode to clean debris from an object. The user may then use the water and cleaning mixture dispensing mode to dispense water and cleaning mixture onto the object until the object is partially covered with a predetermined amount of water and cleaning mixture. The user may further move the bristles 404 of the brush 104 in a scrubbing motion on the object to be cleaned to spread out the predetermined amount of water and cleaning mixture on the object to be cleaned in a predetermined fashion. The user may then use the first water dispensing mode to dispense water onto the object until a predetermined amount of cleaning mixture previously dispensed onto the object to be cleaned is rinsed off the object.

It will be further appreciated by the skilled addressee that the invention according to the first embodiment shown in FIGS. 1, 2A and 2B is operated similarly to the second embodiment shown in FIGS. 7 and 8. In such an embodiment, the cleaning device may be selectively used in a water and cleaning mixture dispensing mode and a water dispensing mode, the switch assembly 108 being selectively moved between the two modes.

Figure 12A:
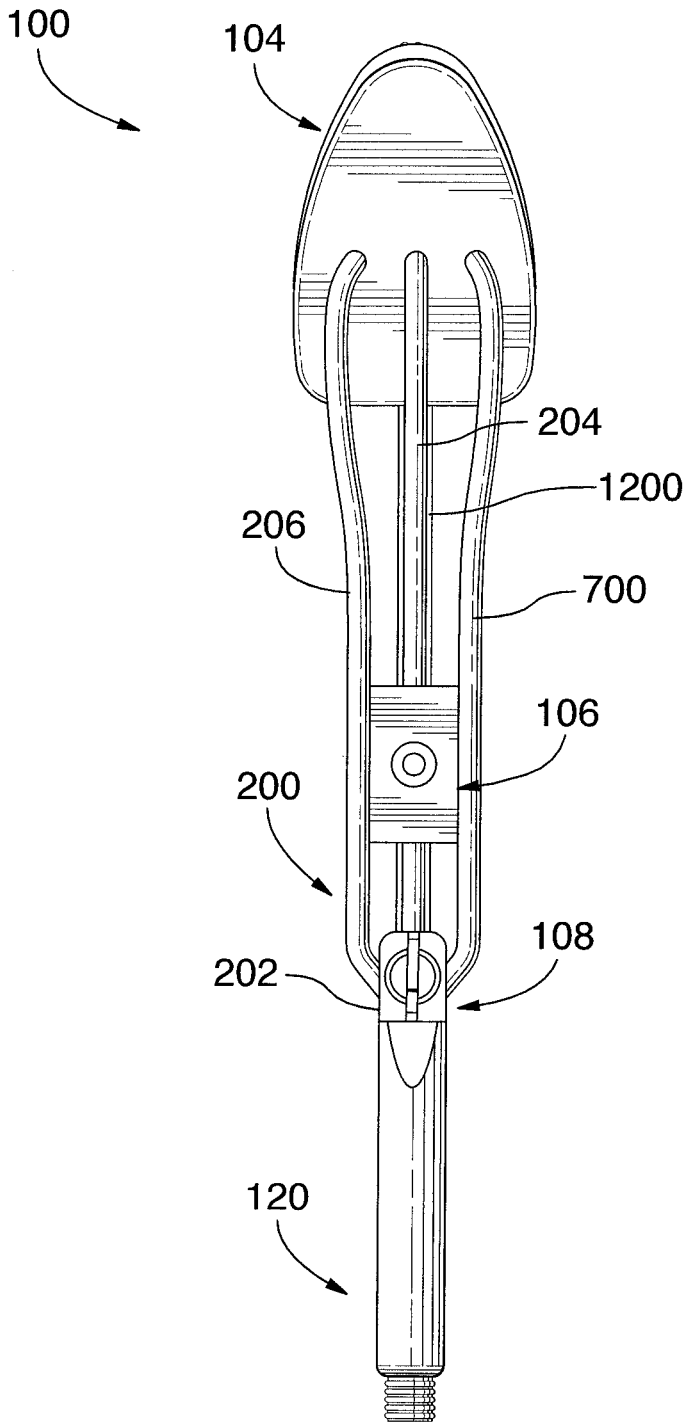
FIG. 12A is a drawing showing a back elevation view of a water-saver cleaning device in accordance with a third embodiment of the present invention.
Figure 12B:
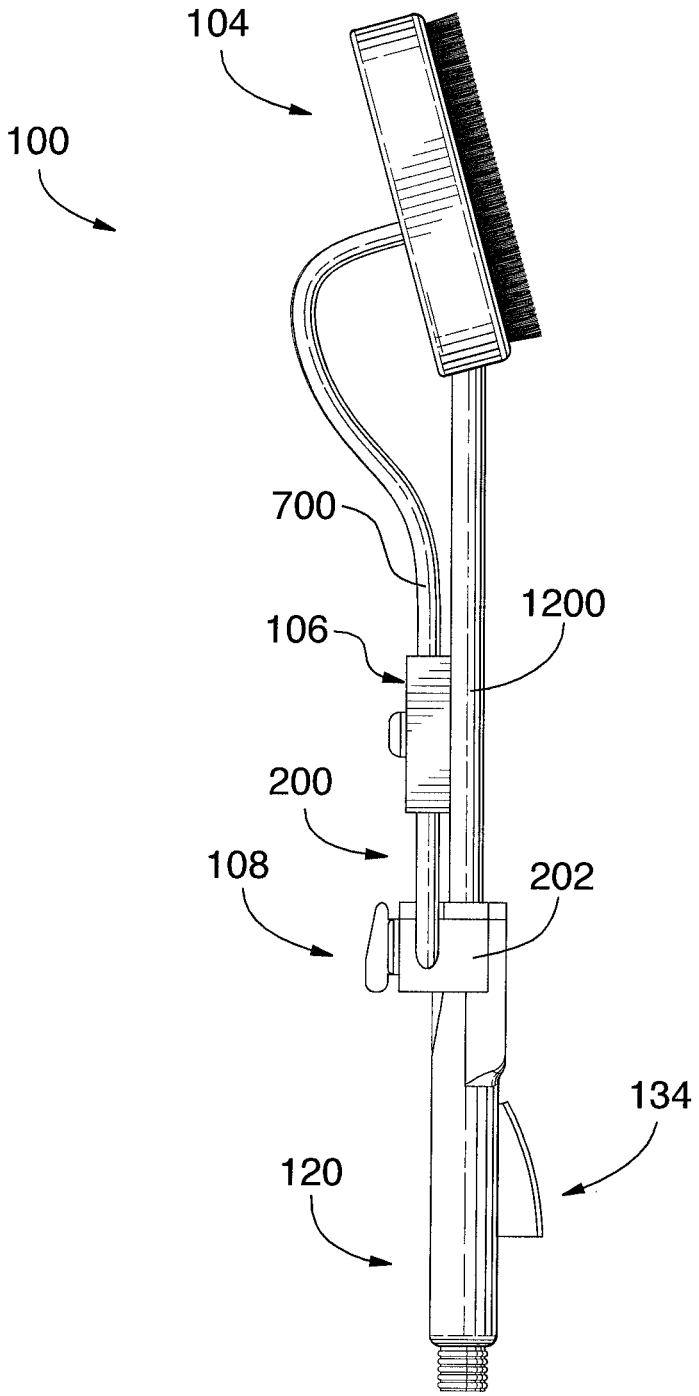
FIG. 12B is a drawing showing a left side elevation view of the water-saver cleaning device shown in FIG. 12A.

Now referring to FIGS. 12A and 12B, there is shown a third embodiment of a water-saver cleaning device 100 to be connected to a water hose, not shown. This embodiment is generally similar to the second embodiment of the present invention shown in FIG. 7.

In addition to the features previously described, this embodiment comprises a connecting shaft 1200 for rigidly mounting the brush 104 to the handle 120. The water and cleaning mixture dispensing tube 204, the water dispensing tube 206 and the second water dispensing tube 700 are made of a flexible material known to the skilled addressee. The skilled addressee will appreciate that this embodiment facilitates maintenance of the cleaning device 100 by allowing the easy removal and replacement of the water and cleaning mixture dispensing tube 204, the water dispensing tube 206 and the second water dispensing tube 700 from the cleaning device 100.

The skilled addressee will further appreciate that the connecting shaft 1200 is subjected to bending stress when a hand holding the handle 120 moves the cleaning device 100 such that the brush 104 is moved in a scrubbing motion over an object to be cleaned. Therefore, the connecting shaft 1200 may be made from a rigid material having bending stress resistance such as polyvinyl chloride, aluminum, stainless steel or any other material the skilled addressee may deem appropriate for the present use of the invention.

Figure 13A:
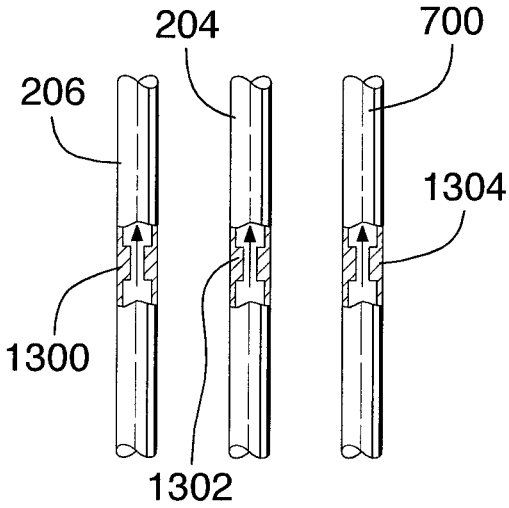
FIG. 13A is a drawing showing a partial cross-section of an enlarged portion of the water-saver cleaning device shown in FIG. 7 in accordance with one embodiment of the present invention.
Figure 13B:
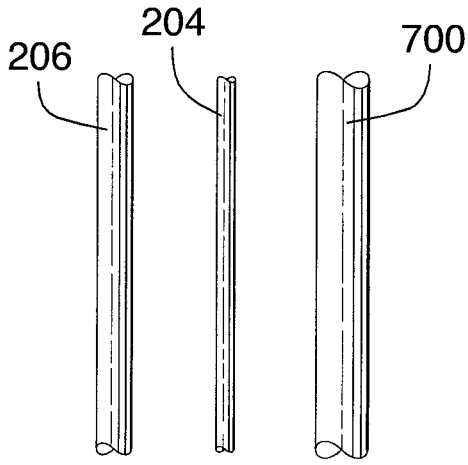
FIG. 13B is a drawing showing a partial cross-section of an enlarged portion of the water-saver cleaning device shown in FIG. 7 in accordance with an alternative embodiment of the present invention.
Figure 13C:
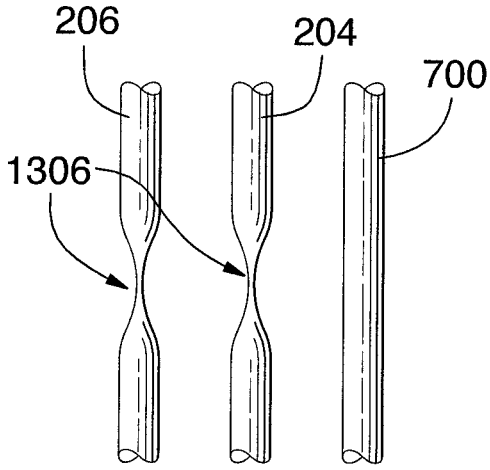
FIG. 13C is a drawing showing a partial cross-section of an enlarged portion of the water-saver cleaning device shown in FIG. 7 in accordance with an alternative embodiment of the present invention.

Now turning to FIGS. 13A, 13B and 13C, there are shown different means that may be used to control the flow rate of water traveling through the water and cleaning mixture dispensing tube 204, the water dispensing tube 206 and the second water dispensing tube 700.

Now referring to FIG. 13A, there is shown a semi-cut view of the water and cleaning mixture dispensing tube 204, the water dispensing tube 206 and the second dispensing tube 700. According to the embodiment shown, each tube is provided with constricting elements 1300, 1302 and 1304 inserted therein, the constricting elements 1300, 1302 and 1304 having a central opening of a fixed diameter. The opening of the constricting element 1300 from the water dispensing tube 206 is larger than the opening of the constricting element 1302 from the water and cleaning mixture dispensing tube 204 and the opening of the constricting element 1304 from the second water dispensing tube 700 is larger than the opening of the constricting element 1300 from the water dispensing tube 206.

The skilled addressee will appreciate that the flow rate of water traveling through a tube is related to the opening of the constriction element inserted therein.

Now referring to another embodiment shown in FIG. 13B, the flow rate of water traveling through each tube is correlated to the diameter thereof. Therefore, the diameter of the second water dispensing tube 700 is larger than the diameter of the water dispensing tube 206, which is itself larger than the diameter of the water and cleaning mixture dispensing tube 204.

Now referring to another embodiment shown in FIG. 13C, the flow rate of water traveling through each tube is correlated to the diameter of a constriction 1306. Therefore, the diameter of the second water dispensing tube 700 at the constriction 1306 is larger than the diameter of the water dispensing tube 206 at the constriction 1306, which is itself larger than the diameter of the water and cleaning mixture dispensing tube 204 at the constriction 1306.

The skilled addressee will appreciate that the application of water and cleaning mixture onto an object to be cleaned using the cleaning device 100 set in the water and cleaning mixture dispensing mode wherein water and cleaning mixture is dispensed from the cleaning device 100 is usually followed by a scrubbing motion of the brush 104 of the cleaning device 100 onto the object to be cleaned. As such, the stream of water and cleaning mixture exiting the cleaning device 100 does not need to travel a distance before reaching the object to be cleaned, hence the flow rate being lower in the water and cleaning mixture dispensing mode than in the water dispensing mode and the second water dispensing mode.

In a preferred embodiment, when the cleaning device 100 is set to the water and cleaning mixture dispensing mode, water and cleaning mixture are dispensed from the cleaning device 100 at a flow rate of 1 L/min.

In the water dispensing mode, water is dispensed from the cleaning device 100 with an amount of force sufficient to effectively rinse off cleaning mixture previously applied on an object to be cleaned. The flow rate provided in such mode is thus higher than in the water and cleaning mixture dispensing mode.

Still in a preferred embodiment, when the cleaning device 100 is set to the water dispensing mode, water is dispensed from the cleaning device 100 at a flow rate of 2 L/min.

In the second dispensing mode, water is dispensed from the cleaning device 100 with an amount of force sufficient to clean off debris from an object to be cleaned. The flow rate provided in such mode is thus higher than in the water and cleaning mixture dispensing mode and in the water dispensing mode.

Still in a preferred embodiment, when the cleaning device 100 is set to the second water dispensing mode, water is dispensed from the cleaning device 100 at a flow rate of 3 L/min.

The skilled addressee will appreciate that the flow rates provided are merely suggestions and may be different, given that the rank of flow rate of each mode relatively to the other modes is respected.

The skilled addressee will thus appreciate that the above-described invention is of great advantage since the switch assembly 108 provides the cleaning device 100 with water saving abilities by enabling a user to select a flow rate based on an amount of water needed for a cleaning operation.

For instance, the cleaning of a car using a cleaning device 100 according to one embodiment of the prior art, using a constant flow of water at a flow rate of about 12 L/min as provided by a standard garden hose tap known to the skilled addressee, may consume about 144 L of water. The cleaning of a car using a cleaning device 100 according to one embodiment of the present invention may consume about 28 L of water, providing a saving of about 81% of the total amount of water used in the process.

The switch assembly 108 further enables a user to selectively use for a cleaning operation water with cleaning mixture or water without cleaning mixture, for a rinsing phase of a cleaning operation for instance. The present invention further offers to a user a notable advantage over prior art by eliminating the need to successively plug and unplug multiple device to and from the water hose to dispense water from the cleaning device 100 at different flow rates.

Although the above description relates to a specific preferred embodiment as presently contemplated by the inventor, it will be understood that the invention in its broad aspect includes mechanical and functional equivalents of the elements described herein.

The invention claimed is:

1. A cleaning device to be connected with a water hose, the cleaning device comprising:

a water inlet at a first end for receiving the water hose;

an outlet assembly having a brush located at a first end thereof;

a cleaning mixture reservoir in fluid communication with the outlet assembly; and a flow selection assembly operatively coupled to said water inlet, said outlet assembly and said cleaning mixture reservoir, said flow selection assembly comprising a switch assembly for switching between:

a water and cleaning mixture dispensing mode wherein the water inlet is in fluid communication with the cleaning mixture reservoir and the outlet assembly and the water is dispensed at a first given flow rate;

a first water dispensing mode wherein the water inlet is in fluid communication with the outlet assembly and water is dispensed at a second given flow rate greater than the first given flow rate; and a second water dispensing mode wherein said water inlet is in fluid communication with said outlet assembly and water is dispensed at a third given flow rate greater than the second given flow rate.

2. The cleaning device as claimed in claim 1, wherein said switch assembly comprises:

an entry port in fluid communication with said water inlet;

a water and cleaning mixture dispensing port in fluid communication with said entry port when said switch assembly is in said water and cleaning mixture dispensing mode;

a water and cleaning mixture dispensing tube extending between said water and cleaning mixture dispensing port and said outlet assembly;

a first water dispensing port in fluid communication with said entry port when said switch assembly is in said first water dispensing mode;

a first water dispensing tube extending between said water dispensing port and said outlet assembly;

a second water dispensing port in fluid communication with said entry port when said switch assembly is in said second water dispensing mode; and a second water dispensing tube extending between said second water dispensing port and said outlet assembly.

3. The cleaning device as claimed in claim 2, wherein said switch assembly comprises a switch having a water communication opening selectively positionable between said water and cleaning mixture dispensing port and said entry port, between said first water dispensing port and said entry port and between said second water dispensing port and said entry port such that when said switch assembly is in said water and cleaning mixture dispensing mode, said water communication opening is in fluid communication with said water and cleaning mixture dispensing port and said entry port; when said switch assembly is in said first water dispensing mode, said water communication opening is in fluid communication with said first water dispensing port and said entry port and when said switch assembly is in said second water dispensing mode, said water communication opening is in fluid communication with said second water dispensing port and said entry port.

4. The cleaning device as claimed in claim 3, wherein said switch comprises a rotatable switch selectively rotating between a water and cleaning mixture position wherein said switch assembly is in said water and cleaning mixture dispensing mode, a first water dispensing position wherein said switch assembly is in said first water dispensing mode and a second water dispensing position wherein said switch assembly is in said second water dispensing mode.

5. The cleaning device as claimed in claim 3, wherein said switch assembly comprises a translatable switch selectively translating between a water and cleaning mixture position wherein said switch assembly is in said water and cleaning mixture dispensing mode, a first water dispensing position wherein said switch assembly is in said first water dispensing mode and a second water dispensing position wherein said switch assembly is in said second water dispensing mode.

6. The cleaning device as claimed in claim 1, wherein said switch assembly comprises:

a water routing assembly operatively coupled to said water inlet, said water routing assembly comprising an entry port in fluid communication with said water inlet, said water routing assembly further comprising a water and cleaning mixture dispensing port in fluid communication with said entry port, a first water dispensing port in fluid communication with said entry port and a second water dispensing port in fluid communication with said entry port;

a water and cleaning mixture dispensing tube extending between said water and cleaning mixture dispensing port and said outlet assembly;

a water and cleaning mixture dispensing switch operatively coupled to said water and cleaning mixture dispensing tube, said water and cleaning mixture dispensing switch selectively moving between an open position wherein water is dispensed from said water and cleaning mixture dispensing port to said outlet assembly when water enters said cleaning device through said water inlet and a closed position wherein dispensing of water from said water and cleaning mixture dispensing port to said outlet assembly is prevented;

a first water dispensing tube extending between said water dispensing port and said outlet assembly;

a first water dispensing switch operatively coupled to said first water dispensing tube, said water dispensing switch selectively moving between an open position wherein water is dispensed from said first water dispensing port to said outlet assembly when water enters said cleaning device through said water inlet and a closed position wherein dispensing of water from said first water dispensing port to said outlet assembly is prevented;

a second water dispensing tube extending between said second water dispensing port and said outlet assembly; and a second water dispensing switch operatively coupled to said second water dispensing tube, said water dispensing switch selectively moving between an open position wherein water is dispensed from said second water dispensing port to said outlet assembly when water enters said cleaning device through said water inlet and a closed position wherein dispensing of water from said second water dispensing port to said outlet assembly is prevented.

7. The cleaning device as claimed in claim 1, wherein said first end comprises a handle for handling said cleaning device using a hand.

8. The cleaning device as claimed in claim 7, wherein said handle comprises an actuation mechanism, said actuation mechanism comprising a check valve selectively moving between an open position wherein water is dispensed from said water inlet to said flow selection assembly when water enters said cleaning device through said water inlet and a closed position wherein dispensing of water from said water inlet to said flow selection assembly when water enters said cleaning device through said water inlet conduit is prevented.

9. The cleaning device as claimed in claim 8, wherein said actuation mechanism further comprises a depressible lever adapted to be actuated by at least one finger of a hand holding said handle, said depressible lever selectively moving said check valve between said open position and said closed position.

10. The cleaning device as claimed in claim 8, wherein said actuation mechanism further comprises a hinged lever having a first grasping end adapted to be grasped by at least one finger of a hand holding said handle and a second, opposite hinge end hingedly connected to said handle using a hinge, said hinged lever selectively moving said check valve between said open position and said closed position.

11. The cleaning device as claimed in claim 8, wherein said water inlet comprises an externally threaded cylindrical inlet connector extending axially and outwardly from said handle, said externally threaded cylindrical inlet connector being adapted to threadily engage a corresponding internally threaded portion of said water hose.

12. The cleaning device as claimed in claim 1, wherein said water inlet comprises a quick disconnect fitting adapted to engage a corresponding quick disconnect fitting provided with said water hose.

13. A method for manufacturing the cleaning device as claimed in claim 1 consisting in assembling said water inlet, said outlet assembly, said cleaning mixture reservoir and said flow selection assembly using an assembling method.

14. The method as claimed in claim 13, wherein said assembling method is selected from a group comprising gluing, friction welding and thermoforming.

15. A method for cleaning an object using the cleaning device as claimed in claim 1 wherein said water hose is connected to a water source and cleaning mixture is provided in said cleaning mixture reservoir.

* * * * *